United States Patent [19]

Palazzo

[11] Patent Number: 4,744,137

[45] Date of Patent: May 17, 1988

[54] METHOD OF MAKING DOUBLE WALL STORAGE TANK FOR LIQUIDS

[76] Inventor: David T. Palazzo, P.O. Box 290676, Tampa, Fla. 33687

[21] Appl. No.: 43,634

[22] Filed: Jun. 11, 1987

Related U.S. Application Data

[60] Division of Ser. No. 884,481, Sep. 11, 1986, abandoned, and a continuation-in-part of Ser. No. 775,140, Sep. 12, 1985, Pat. No. 4,640,439, and a continuation-in-part of Ser. No. 818,258, Jan. 13, 1986, Pat. No. 4,644,627.

[51] Int. Cl.[4] ..... B23P 9/00

[52] U.S. Cl. ..... 29/455 R; 29/463; 138/149; 156/173; 215/12.2; 220/445; 264/251

[58] Field of Search ..... 29/455 R, 463; 156/171-173, 175, 143, 293, 294, 291; 220/420, 445, 448, 466, 469, 465, 1 B, 226, 855; 138/148, 149; 215/12 A; 264/251, 318

[56] References Cited

U.S. PATENT DOCUMENTS

| | | | |
|---|---|---|---|
| 2,303,395 | 12/1942 | Schultz et al. | 264/251 X |
| 2,551,710 | 5/1951 | Slaughter | 29/455 R U X |
| 3,293,860 | 12/1966 | Stedfeld | 156/173 X |
| 3,746,595 | 7/1973 | Leason | 264/251 X |
| 3,802,975 | 4/1974 | Saidla | 156/173 X |
| 3,806,391 | 4/1974 | Clay et al. | 156/291 X |
| 3,921,273 | 11/1975 | Kondo et al. | 29/455 R X |
| 4,537,328 | 8/1985 | Keese | 220/445 |
| 4,579,617 | 4/1986 | Oberg et al. | 215/12 A X |

FOREIGN PATENT DOCUMENTS

| | | | |
|---|---|---|---|
| 197808 | 8/1978 | Switzerland | 220/445 |

*Primary Examiner*—Charlie T. Moon
*Attorney, Agent, or Firm*—Pettis & McDonald

[57] ABSTRACT

A method is described for manufacturing a rigid double wall tank from a rigid single wall cylindrical inner tank, in which a substantially rigid sheath is formed over a male mold which has a configuration generally similar to that of the inner tank and provides for molding of projections on the inner surface of such cylindrical sheath portion. The cylindrical sheath portion is then removed from the mold and introduced over the inner tank with the projections extending from the cylindrical inner surface of the sheath to the outer surface of the inner tank, and sheath end portions are applied to the axial extremities of that cylindrical sheath portion, forming a complete sheath enclosing the inner tank.

11 Claims, 2 Drawing Sheets

METHOD OF MAKING DOUBLE WALL STORAGE TANK FOR LIQUIDS

RELATED APPLICATION

This application is a division of application Ser. No. 884,481 filed Sept. 11, 1986, now abandoned, which is a continuation-in-part of application Ser. No. 775,140 filed Sept. 12, 1985, and of application Ser. No. 818,258 filed Jan. 13, 1986, both entitled Double Wall Storage Tank for Liquids and Method of Making Same and filed in the name of of David T. Palazzo.

FIELD OF THE INVENTION

This invention relates to tanks for the storage of liquids, and more particularly to double wall tanks for underground storage of liquids.

BACKGROUND OF THE INVENTION

Tanks for the storage of liquids have been constructed in a variety of ways from a variety of materials. In one common application, the underground storage of hydrocarbons, such as gasoline and other petroleum products, the tanks have conventionally been fabricated out of steel or fiberglass, most commonly with a single rigid wall. In many applications this construction has proved reasonably satisfactory, with such tanks functioning properly for many years before requiring repair or replacement. However, the increasing age of many of the tanks currently in place is beginning to present serious environmental dangers. Many of the older steel tanks buried underground have rusted and are beginning to leak, thus releasing the petroleum materials into the ground where they may seep into and pollute underground water supplies. While rustproof, some fiberglass tanks have also exhibited leakage, causing the same problems.

One of the primary problems with leaking storage tanks has been the difficulty or inability to ascertain when or if such leaks are occurring from a given tank. Because the excavation and removal of such a storage tank, which may contain thousands of gallons of fuel, is an expensive and difficult undertaking, such an operation is difficult to justify unless there is some evidence of actual leakage.

Because of the increasing potential danger of leaking storage tanks, particularly in communities that utilize ground water for public consumption, many municipalities have implemented or plan to implement ordinances requiring the use of double wall storage tanks underground and requiring replacement of existing single wall tanks. While the installation of a conventional double wall tank in a new facility entails no great difficulty and a generally manageable increase in cost over a single wall tank, the burden of complying with such ordinances by replacing existing sound, single wall tanks with double wall tanks can be heavy. This burden has prompted the search for methods of fabricating relatively inexpensive double wall tanks. This burden has also given impetus to the search for a method of remanufacturing existing single wall tanks into a double wall assembly with means for detecting the presence of any leaks into the space between the two walls.

SUMMARY OF THE INVENTION

In view of the foregoing, it is the object of the present invention to provide an economical method of manufacturing a double wall storage tank from rigid single wall tank. It is a further object of the invention to provide such a method in which at least a portion of the outer wall or sheath of the tank is spaced from the inner tank. It is an additional object of this invention to provide a double wall storage tank in which at least a portion of the outer wall or sheath of the tank is spaced from the inner tank.

To achieve these and other objects that will become readily apparent to those skilled in the art, this invention provides a method of manufacturing a rigid, double wall tank for storage of liquids from a rigid, single wall, cylindrical inner tank, the outer surface of which has cylindrical sidewall portions of predetermined axial length and diameter and end portions extending generally transverse to the sidewall portions. The method includes the steps of forming a male mold having a cylindrical configuration generally similar to the configuration of the inner tank, and removably applying over the mold cylindrical sidewall portions a substantially rigid sheath portion of a material that is substantially liquid tight and conforms generally to the mold sidewall surface. The mold cylindrical sidewall outer portions have a diameter greater than the inner tank sidewall diameter and have a plurality of depressions each extending generally radially inwardly of the mold sidewall outer portions a distance generally equal to half the difference between the diameter of the mold sidewall outer portions and the inner tank diameter. The cylindrical sheath thus formed has a generally cylindrical inner surface with a plurality of projections extending generally radially inwardly thereof in general conformity with the mold depressions. The cylindrical sheath portion is removed from the mold and introduced over the inner tank with such projections engaging the inner tank cylindrical sidewall portions, and substantially rigid and liquid tight sheath end portions are then applied to the axial extremities of the cylindrical sheath portion, these end portions overlying the inner tank end portions and extending generally transverse to the cylindrical sheath portion. The structure thus forms a sheath enclosing the inner tank with the radially inwardly extending projections of the sheath spacing the cylindrical inner surface of the cylindrical sheath portion from the outer surface of the inner tank to permit passage of liquid therebetween, thus defining a double wall tank.

BRIEF DESCRIPTION OF THE DRAWINGS

A particularly preferred embodiment of the method and apparatus of this invention will be described in detail below in connection with the drawings, in which.

DESCRIPTION OF A PREFERRED EMBODIMENT

Figure 1:
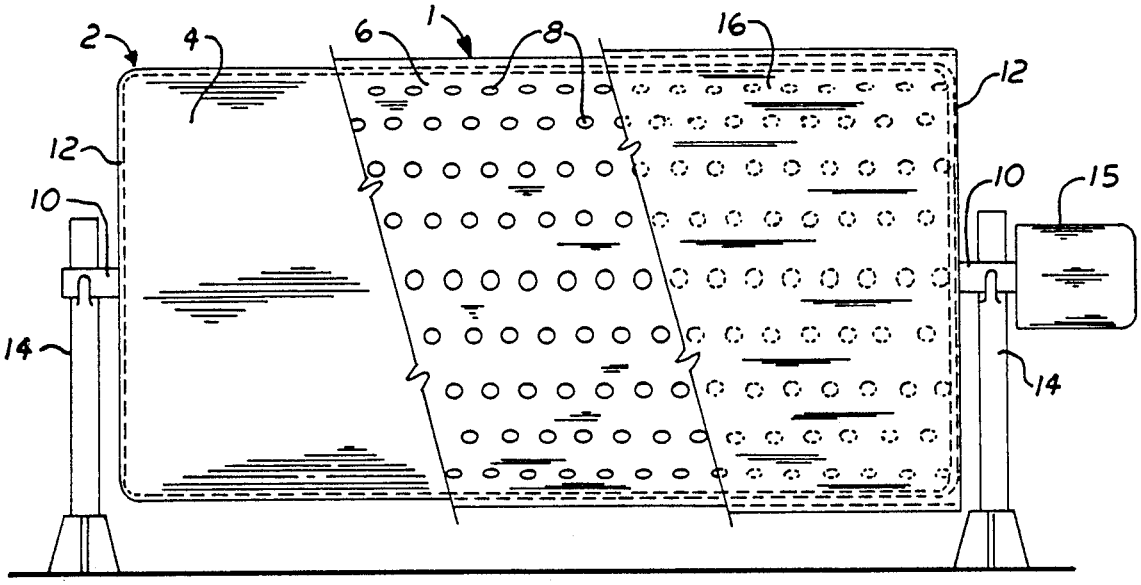
FIG. 1 is a side elevational view, partially in section, of a tank according to the present invention, illustrating the initial steps in the fabrication process.

A preferred embodiment of the method and apparatus of this invention is illustrated in the drawings, with certain of the figures illustrating intermediate steps in the process.

Figure 2:
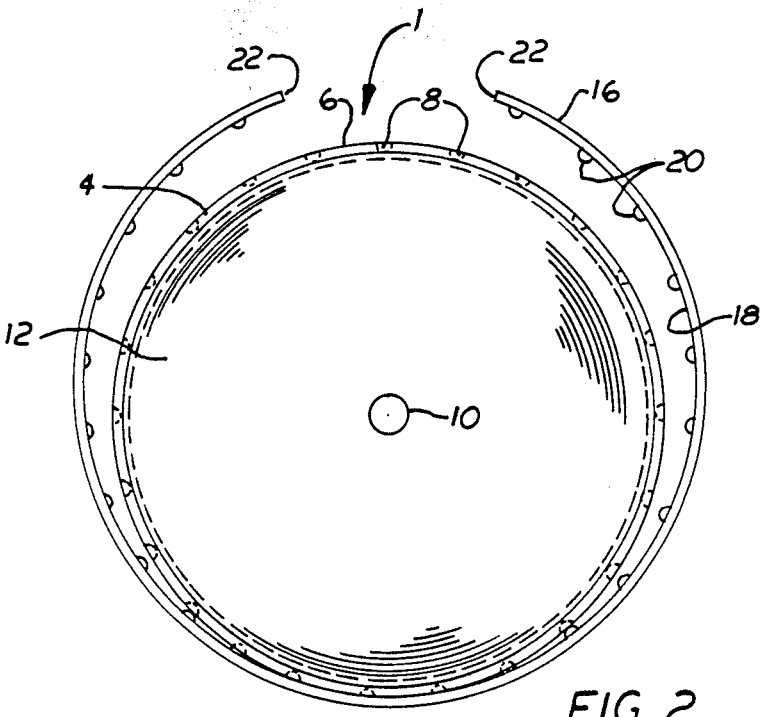
FIG. 2 is an end sectional view of the method and apparatus of FIG. 1 illustrating the step of removing the cylindrical sheath portion from the mold.

To fabricate a tank according to the process of this invention it is necessary to create a male mold over which at least the cylindrical sidewall portion of the tank sheath is to be formed. One embodiment of a suitable mold for this invention is illustrated in FIGS. 1 and 2. This mold comprises a member 2 having a cylindrical configuration generally similar to that of the inner tank to be used in the completed double wall tank. Over this cylindrical member 2 is applied a layer of a material 6 to which resins do not readily adhere. Such material may suitably be a high density polymer such as a high density polyethylene or Teflon, or an equivalent. This material 6, which may suitably be on the order of one-quarter to one-half inch in thickness, is attached to the cylindrical sidewall 4 of the mold member 2 by any convenient means, such as by countersunk screws or the like. Preferably this sheet material 6 covers substantially the entire cylindrical sidewall 4 of the mold member 2.

This sheet material 6 is provided with a plurality of depressions 8, which may suitably have the configuration of a segment of a sphere or other geometrical shape, or may be in the form of elongated grooves or other convenient shapes. When this material 6 is attached over the mold member 2 these depressions 8 extend generally radially inwardly of the outer surface of the material 6 and thus of the mold 1, a distance generally equal, on the average, to half the difference between the diameter of the mold sidewall outer portions defined by the outer surface of the material 6 extending about the member 2, and the diameter of the inner tank that is to be used in forming the double wall tank of this invention. The surface of the material 6 thus defines the mold sidewall outer portions. It is to be understood that the desired male mold may be formed in numerous other ways, such as by machining the depressions directly into the large cylindrical member 2 or by numerous other techniques, all of which are within the scope of this invention.

The mold member 2, with the material 6 applied thereover, preferably is supported off the ground in the manner shown in FIG. 1. This may be accomplished by the affixation of spindles 10 to each respective end portion 12 of the mold member 2. The spindles preferably are affixed to these end portions 12 substantially concentric with the cylindrical axis of the member 2. The spindles 10 are then supported or journalled for rotation on support uprights 14. If desired, suitable rotational drive means 15 may be affixed to the spindles 10 to provide any desired mechanical drive for rotation of the mold 1 during the fabrication steps to be described below.

Once the mold 1 has been prepared and is coated with a mold release material, whether it be a separately applied liquid or an inherent characteristic of the material 6, fabrication may be undertaken of the sheath portions to be applied over the inner tank, and particularly the cylindrical sheath portion be applied over the cylindrical sidewall of the inner tank. In a preferred embodiment, an appropriate and well known curable resin is applied to the cylindrical sidewall outer portion 6 of the mold, filling the depressions 8 extending inwardly of that cylindrical mold surface. Then, conveniently, a fibrous material such as glass fiber matting or woven sheets may be applied over the resin and the mold sidewall 6. Suitably this application may be effected by rotation of a mold 1 on its spindle 10, thus facilitating wrapping the resin coated mold with such fibrous material. Additional resin may then be applied to the exterior of the fibrous material and the resin impregnated material permitted to cure. Of course, it is also possible to use a preimpregnated fibrous matting with equal facility.

Upon curing, this combination of resin and fibrous material thus forms a cylindrical sheath 16 having a cylindrical outer surface and a generally cylindrical inner surface 18 with a plurality of projections 20 extending generally radially inwardly of that surface 18 in general conformity with the mold depressions 8. This structure is best illustrated in FIG. 2 where removal of the cylindrical sheath member 16 from the mold 1 is illustrated.

When the resin comprising a portion of the cylindrical sheath member 16 has cured, the cylindrical sheath member 16 is then removed from the mold 1. In this preferred embodiment such removal is effected by forming an opening through the sheath cylindrical member 16, with that opening extending the full axial length of that cylindrical member 16. This opening may be formed slitting, suitably by means of a circular saw, along the entire axial length of the cylindrical member 16. When this opening or slit is being made through the sidewall of the cylindrical sheath member 16, it is desirable to set the cutting depth of the saw blade sufficient to just cut through the resin impregnated glass fiber forming that sheath portion to minimize damage to the surface of the mold 1. Alternatively, it is possible to provide a slot in the mold surface covered by a thin tape or the like for receiving the saw blade during the cutting process. Yet another approach is to provide a strip of spacing material extending axailly along a portion of the surface of the mold to sacrificially receive the saw blade while maintaining that saw blade spaced above the surface of the mold itself.

When the opening, or slit, whose edges are indicated by the reference numeral 22 in FIG. 2, has been made, the cylindrical sidewall portion comprising the member 16 of the sheath may then be pulled open and away from engagement with the surface material 6 of the mold 1, as shown in FIG. 2. When this sheath cylindrical sidewall portion 16 has been completely freed from engagement with the cylindrical sidewall of the mold 1, it may then be removed from the mold either by sliding the sheath portion axially off the end of the mold, with the mold being appropriately supported, or by spreading the edges 22 of the opening sufficiently far apart to allow removal in a direction transverse to the axis of the mold 1.

When the sheath cylindrical sidewall portion 16 has been removed from the mold 1, it may then be introduced over an inner tank 24 that is to be the primary container for liquid storage. As previously noted, the most common shape for such an inner tank is that of a cylinder, generally a right circular cylinder having closed end portions. This inner tank 24 may be constructed of any rigid material, such as metal or fiber glass or other material, although the most common structure is formed of welded steel having an appropriate corrosion resisting coating on the liquid contacting surfaces. In this preferred embodiment such a steel tank will be described. It is to be understood that the tank to be used as the inner tank 24 may be a newly fabricated tank, which may but generally does not have any manhole opening cut in it. Alternatively, the tank may be a previously used tank removed from its prior underground installation and cleaned for reuse with this invention. With such a reused tank it is generally convenient, although not necessary, for this invention that any manhole openings or plumbing attachments be removed and covered prior to the fabrication process.

To prepare an uncoated or previously used steel tank 24, it is desirable that the exterior surface be conventionally sandblasted and coated with a rust inhibiting material, such as paint. At that point the inner tank 24 is ready for introduction of the cylindrical sheath portion thereover. It generally is preferable to form any apertures, such as for a man hole 26 (FIG. 3) or for plumbing fixtures 28 (FIG. 5) through the wall of the inner tank prior to reception of the sheath thereover, although such apertures could also be formed subsequent to reception of the sheath over the tank 24.

Figure 3:
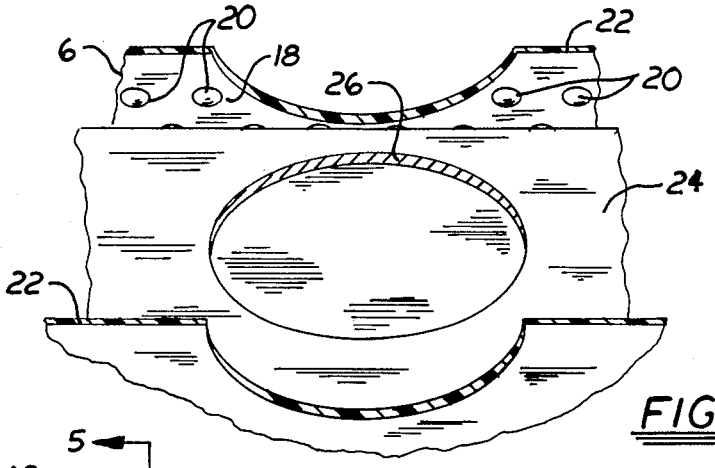
FIG. 3 is a fragmentary upper perspective view of the method of this invention illustrating the introduction of the cylindrical sheath portion over the inner tank and the forming of a manhole aperture through the tank wall and sheath.

The cylindrical sheath portion 16 may then be introduced over the inner tank 24 in substantially the same manner, with reversal of steps, that it was removed from the mold 1. Prior to rejoining the edges 22 of the axial opening through the sheath, apertures through the sheath corresponding to the apertures through the inner tank 24 may be formed, as shown in FIG. 3. It is also possible, although less convenient, to form the apertures through the cylindrical sheath portion subsequent to rejoining the edges 22 thereof.

Figure 4:
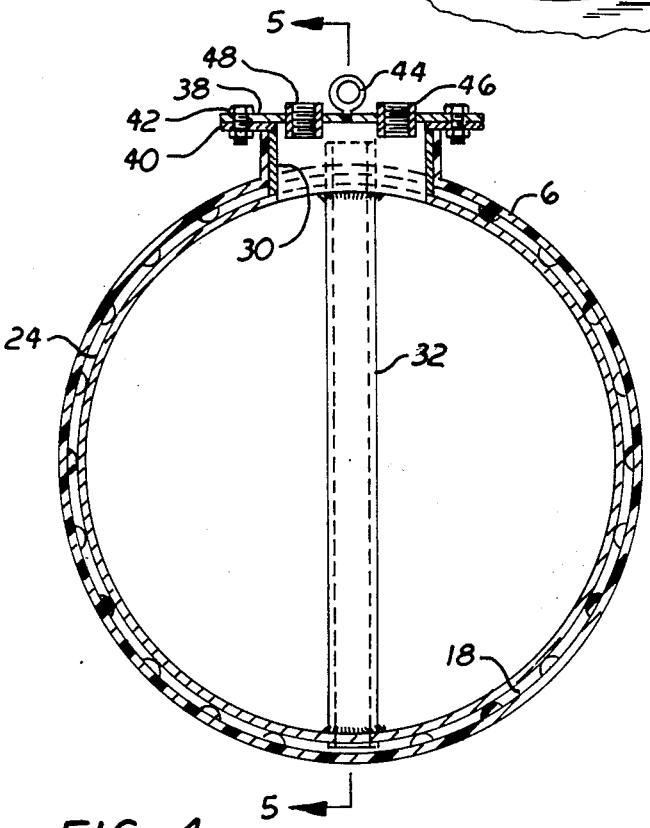
FIG. 4 is an end sectional view of a completed tank according to this invention.
Figure 5:
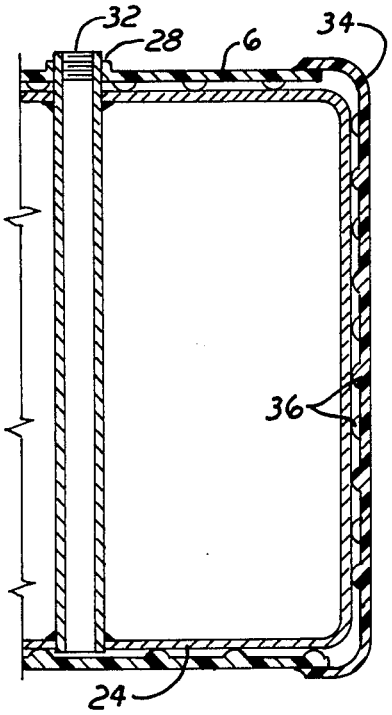
FIG. 5 is a partial side sectional view taken along line 5—5 of FIG. 4.
Figure 6:
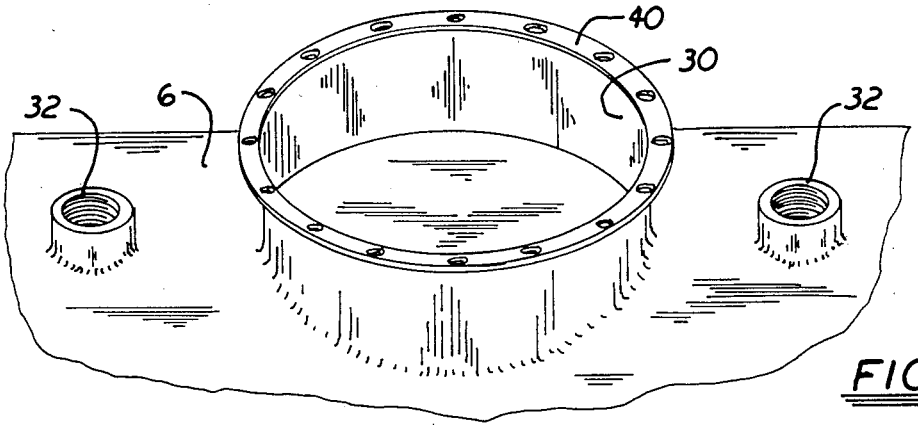
FIG. 6 is a fragmentary upper perspective view of the apparatus of FIGS. 5 and 6, illustrating the completed installation of a manhole port and of the plumbing connections to the completed tank.

After any such apertures have been formed, a hollow cylindrical member 30, preferably having the shape and size corresponding generally to the shape and size of the aperture 26, is sealingly joined to the cylindrical sidewall of the inner tank 24, suitably by welding the joint adjacent the periphery of the aperture to the tank 24. As shown in FIGS. 4 and 6, this provides a manhole for access to the interior of the tank. Additional fittings, such as for tube 32, may also be attached, suitably by welding, within other apertures, such as aperture 28, formed in the tank 24 cylindrical sidewall. When all of these fittings have been affixed to the tank in the preferred embodiment of this invention, the edges 22 of the sheath cylindrical portion 6 that had been spread apart during these steps may then be brought back together, with that cylindrical member 6 then again forming a generally cylindrical sheath portion about the sidewall of the inner tank 24. Because the projections 20 extend radially inwardly from the cylindrical sheath inner surface 18 an average distance generally equal to half the difference between the diameter of the mold sidewall outer portion over which it was formed and the diameter of the inner tank 24, these projections 20 space the cylindrical inner surface 18 of the cylindrical sheath portion 6 from the outer surface of the inner tank 24 when the edge 22 of the axially opening in that cylindrical sheath are brought back together. With those edges 22 again brought together, the opening may be closed liquid tight, suitably by application of appropriate resin, with or without reinforcing tape or glass fiber cloth. Thus, the sheath portion 6 is returned to its configuration as a continuous, generally cylindrical structure, as shown in FIGS. 4, 5 and 6. The portions of the cylindrical sheath portion 6 adjacent the fittings, such as the manhole cylindrical member 30 and the fittings 28 may then be bonded thereto with appropriate resins, thus yielding a finished cylindrical structure as shown in the fragmentary perspective view of FIG. 6.

In the preferred embodiment of this invention, the end portions 34 of the sheath may be fabricated separately from the cylindrical sidewall portion 6, as by forming over another male mold plug. Such end portion plug mold preferably is provided with a plurality of depressions corresponding to those depressions 8 on the cylindrical mold to provide spacing projections 36 on the inner surface of the sheath end portion 34, as shown in FIG. 5. Alternatively, a separate spacing material could be provided and bonded to the inner surface of this end portion 34, or the spacing elements be foregone entirely on these end portions 34 with only a modest reduction in performance. These preformed end portions 34 may then be placed over the end portion of the inner tank 24 and joined to the respectively axial extremities of the cylindrical sheath portion 6, suitably by application of additional resin to form a liquid tight seal, as illustrated in FIG. 5.

An alternative approach to the formation of the end portions 34 may simply be the formation of those end portions directly over the tank end portions by laying resin impregnated glass fiber mat over the tank end portions and the axial extremities of the cylindrical sheath portion 6. If the sheath end portions 34 are formed in this direct layup manner, it is desirable to provide a spacing material, or at least a mold release agent, between the tank end portions and the resin impregnated fiber mat forming the sheath end portion. This will prevent the bonding of the sheath end portion 34 to the tank end portion and provide for passage of liquid between the tank end portion and the inner surface of the sheath end portion. The final result of this alternative technique is substantially the same as with the above-described preferred technique of separate fabrication and subsequent application of the sheath end portions 34.

As shown in FIGS. 4 and 5, a tube 32 may extend through apertures formed through two portions of the cylindrical sidewalls of the tank 24. These sidewall portions are preferably a first, or top portion, alongside the manhole cylindrical member 30 and a second, or bottom, sidewall portion generally diametrically opposed to the first. The tube 32 preferably extends between an upper point exterior to the sheath 6 and a point adjacent the inner surface of the sheath bottom or second sidewall portion, as shown in FIGS. 4 and 5. As with the manhole cylindrical member 30, the joints between the tube 32 and both the cylindrical sheath portion 6 and the sidewalls of the inner tank 24 are sealed liquid tight in conventional manners. The opening of this tube 32 between the sidewall second portion of the inner tank 24 and the inner surface 18 of the cylindrical teeth portion 6 thus permits pressure testing of the sheath and the tank and also permits the detection and the extraction of any liquid present in that space between the respective sidewalls of the inner tank 24 and the sheath 6.

A suitable coverplate 38 may be provided for the cylindrical member 30 as shown in FIG. 4. This coverplate 38 may conveniently be secured to the upper flange 40 of that cylindrical member 30 by conventional means, such as plurality of bolts 42 extending through the coverplate 38 and the flange 40. In this coverplate 38 may be provided such items as a lifting ring 44 and conventional fittings 46 and 48 to provide for insertion of appropriate plumbing to facilitate introduction and withdrawal of liquids to be stored within the completed tank.

Upon completion of the manufacturing steps set forth above, both the inner tank 24 and its sheath 6 may have pressure applied to them as by compressed air. With the apparatus illustrated, the application of pressure through the tube 32 will permit not only the testing of the sheath for any leakage but also the testing of the tank 24 to ascertain if there is any leakage of that pressurized air from the space between the sheath and the inner tank 24 into the inner tank 24. Such application of pressure will also serve to pop free any portion of the sheath end portions 34 that may have stuck to the release agent applied to the end portions of the inner tank 2, if the sheath end portions are fabricated by the direct layup method. This will then permit the passage of liquids along the exterior surface of the end portion of the inner tank 24.

By the foregoing construction there is thus provided a double wall tank that can be manufactured economically from a conventional steel single wall tank and even from a used tank that had previously been removed from underground storage use. This structure provides a sealed sheath, which may be formed from a material that is liquid tight and free of any tendency to rust or corrode and which is spaced from the inner tank to permit the collection within that space and this detection of any liquids leaking into that space, either from the tank or from sources exterior to the sheath. Thus, may be determined the existence of any leakage of either the tank or the sheath by simply detecting the presence and nature of any liquid present in that space. By the use of a relatively thick and rigid outer sheath, on the order of one-quarter to one-half inch, the strength of that sheath is enhanced over similar structures that may use a flexible outer covering. Furthermore, such a rigid external sheath permits testing of the integrity of the sheath and tank at substantial pressures, which could not be done with a flexible covering without danger of rupture. By the use of the male mold for forming the cylindrical portions of the sheath, far easier and faster production may be obtained than by use of prior art methods in which individual spacing elements, such as lengths of split plastic tubing, are bonded to the exterior of the inner tank with a preimpregnated mat of glass fibers then being applied thereover.

While the foregoing describes in detail a preferred embodiment of the tank of this invention, it is to be understood that such description is illustrative only of the principles of the invention and is not to be considered limitative thereof. Because numerous variations and modifications of both the method of manufacture and the resulting tank will readily occur to those skilled in the art, the scope of this invention is to be limited solely by the claims appended hereto.

What is claimed:

1. A method of manufacturing a rigid, double wall tank for storage of liquids from a rigid, single wall, cylindrical inner tank the outer surface of which has cylindrical sidewall portions of predetermined axial length and diameter and end portions extending generally transverse to said sidewall portions, said method comprising the steps of forming a male mold having a cylindrical configuration generally similar to the configuration of said inner tank, with the cylindrical sidewall outer portions of said mold having a diameter greater than said inner tank sidewall diameter, said mold cylindrical sidewall surface having a plurality of depressions each extending generally radially inwardly of said mold sidewall outer portions an average distance generally equal to half the difference between said diameter of said mold sidewall outer portions and said inner tank diameter;

removably applying a moldable and hardenable material over said mold cylindrical sidewall portions and the depressions therein to form a substantially rigid sheath portion of a material that is substantially liquid tight and conforms generally to said mold sidewall surface and the depression therein, whereby is formed a cylindrical sheath portion having a generally cylindrical inner surface with a plurality of projecting extending generally radially inwardly thereof in general conformity with the mold depressions;

removing said cylindrical sheath portion from said mold;

introducing said cylindrical sheath portion over said inner tank with said projections engaging said inner tank cylindrical sidewall portions, whereby the radially inward projections of the sheath space the cylindrical inner surface of the cylindrical sheath portion from the outer surface of the inner tank to permit passage of liquid therebetween; and applying to the axial extremities of said cylindrical sheath portion substantially rigid and liquid tight sheath end portions overlying said inner tank end portions and extending generally transverse to said cylindrical sheath portion, whereby is formed a liquid tight sheath enclosing the inner tank, thus defining a double wall tank.

2. The method of claim 1 wherein said removing said cylindrical sheath portion from said mold includes the step of forming an opening through said cylindrical sheath portion extending the full axial length of said cylindrical sheath portion; and said introducing of said cylindrical sheath portion over said inner tank includes the step of closing said axially extending opening in a liquid tight manner.

3. The method of claim 1 wherein said mold cylindrical sidewall outer portions are formed of a material resistant to bonding with said sheath material, whereby removal of the cylindrical sheath portion from the mold is facilitated.

4. The method of claim 3 wherein said mold cylindrical sidewall outer portions are formed of a high density polymer material.

5. The method of claim 2 further comprising the steps of forming an aperture through said cylindrical sheath portion and a corresponding aperture through said inner tank sidewall, whereby said apertures provide access to the interior of said inner tank.

6. The method of claim 5 further comprising the steps of sealingly joining to said inner tank sidewall adjacent the periphery of said aperture therethrough a hollow cylindrical member having a shape and size of said inner tank aperture, and sealingly joining said cylindrical sheath portion to the exterior of said hollow cylindrical member.

7. The method of claim 6 wherein said aperture through said cylindrical sheath portion is located intersecting a portion of said opening extending the full axial length of said cylindrical sheath portion.

8. The method of claim 7 wherein said apertures through said cylindrical sheath portion and through said inner tank sidewall are formed prior to the step of closing said sheath opening.

9. The method of claim 1 wherein said sheath material comprises at least one layer of fibrous material coated with a curable resin which, upon curing, provides a coating that is resistant to the passage of water or hydrocarbon liquids.

10. The method of claim 9 wherein said fibrous material comprises a mat of glass fibers.

11. The method of claim 1 wherein said sheath end portions are formed separately from said cylindrical sheath portion and are then joined to the axial extremities of said cylindrical sheath portion in a liquid tight manner.

* * * * *